US005617884A

United States Patent [19]

Allison

[11] Patent Number: 5,617,884

[45] Date of Patent: Apr. 8, 1997

[54] DENTAL HYGIENE SYSTEM WITH DETACHABLE HEAD TOOTHBRUSH

[76] Inventor: Duane M. Allison, 1250 Ryan Ave. East, Maplewood, Minn. 55109

[21] Appl. No.: 291,863

[22] Filed: Aug. 17, 1994

[51] Int. Cl.[6] ..... A46B 9/04; A46B 17/00; A47B 81/02

[52] U.S. Cl. ..... 132/310; 132/308; 132/309; 15/143.1; 15/145; 15/167.1; 15/176.1; 211/65; 211/70.6; 248/111; 248/313; D4/104; D4/108; D6/528; D6/534

[58] Field of Search ..... 15/143.1, 145, 15/167.1, 167.2, 176.1–176.6; 132/308–311; 211/65, 66, 59.1, 70.6; 248/110, 111, 310, 313, 686, 689; D4/104, 108, 113, 199; D6/527, 528, 530, 531, 534, 541

[56] References Cited

U.S. PATENT DOCUMENTS

| | | | |
|---|---|---|---|
| 670,481 | 3/1901 | Kirkwood | 132/310 |
| 1,020,018 | 3/1912 | Bonin | 15/176.2 |
| 1,131,863 | 3/1915 | Phillips | 15/176.6 |
| 1,138,568 | 5/1915 | Hubbel | 15/176.2 |
| 1,453,149 | 4/1923 | Lenief . | |
| 1,618,027 | 2/1927 | Vogler | 132/310 |
| 1,713,379 | 5/1929 | Fromwiller | 132/310 |
| 1,860,911 | 5/1932 | Trimble | 15/176.1 |
| 2,028,694 | 1/1936 | Spinks | 248/110 |
| 2,124,647 | 7/1938 | Bauler | 15/176.2 |
| 2,956,687 | 10/1960 | Robichaud | 211/65 |
| 3,081,783 | 3/1963 | Miller . | |
| 3,369,265 | 2/1968 | Halberstadt et al. . | |
| 3,755,848 | 9/1973 | Mutrie | 132/311 |
| 4,582,075 | 4/1986 | O'Neal et al. | 132/308 |
| 4,598,437 | 7/1986 | Ernest et al. | 15/176.1 |
| 4,811,445 | 3/1989 | Lagieski et al. | 15/104.94 |
| 4,890,349 | 1/1990 | Nitzsche | 15/167.1 |
| 5,033,154 | 7/1991 | Marchand et al. | 15/167.1 |
| 5,058,230 | 10/1991 | Hodesh et al. | 15/167.1 |
| 5,150,495 | 9/1992 | Discko, Jr. et al. | 15/176.1 |
| 5,224,234 | 7/1993 | Aesenault et al. | 15/167.1 |
| 5,228,166 | 7/1993 | Gomez | 15/167.1 |
| 5,247,716 | 9/1993 | Bock | 15/22.1 |
| 5,247,718 | 9/1993 | Victorian | 15/167.1 |
| 5,301,821 | 4/1994 | Jeannet et al. | 248/110 |
| 5,305,490 | 4/1994 | Lundgren | 15/143.1 |
| 5,361,446 | 11/1994 | Rufo | 15/167.1 |
| 5,369,835 | 12/1994 | Clarke | 248/110 |

FOREIGN PATENT DOCUMENTS

| | | | |
|---|---|---|---|
| 1257061 | 7/1989 | Canada | 15/167.1 |
| 676939 | 6/1939 | Germany | 132/308 |
| 379150 | 8/1932 | United Kingdom | 15/167.1 |
| 2044089 | 10/1980 | United Kingdom | 15/176.1 |

*Primary Examiner*—Mark Spisich
*Attorney, Agent, or Firm*—Haugen and Nikolai, P.A.

[57] ABSTRACT

A dental hygiene apparatus, comprised of a toothbrush with a detachable, disposable head and an enlarged handle providing a comfortable, secure grip for people with limited rise of the hand, such as persons with arthritis or other crippling diseases of the hands. The apparatus also comprises a rack with projections adapted to securely hold a plurality of brushes along with a toothpaste tube and a mouthwash bottle.

21 Claims, 7 Drawing Sheets

DENTAL HYGIENE SYSTEM WITH DETACHABLE HEAD TOOTHBRUSH

BACKGROUND OF THE INVENTION

This invention relates to a dental hygiene apparatus, and in particular to a dental hygiene apparatus comprising a toothbrush with a detachable head and an enlarged handle which may be used on a specially designed rack for securely holding multiple brushes, toothpaste, and mouthwash.

The value of a continuous and thorough dental hygiene program for the prevention of dental caries, periodontal diseases and deterioration of tooth surfaces caused by bacterial infection in the mouth is well known. It has been discovered that cavities are developed in teeth as a result of chemical reaction with the tooth surface caused by bacteria constantly present in the mouth. The bacteria produce acids and similar toxins which attack the surface of the teeth and dissolve the surfaces thus producing cavities which must be repaired in order to save the tooth.

Since medical authorities have learned that tooth decay and peridental diseases may be affected by bacterial action, they have come to recognize the need for destroying these bacteria colonies which form on tooth surfaces. The primary function of a toothbrush is to destroy colonies of bacteria and remove plaque so that there will be no buildup in the concentration of plaque and bacteria which will attack the various structures of the mouth.

A toothbrush is, however, also a source of bacterial contamination. Microscopic particles or larger particles frequently become lodged in the bristles and then they reenter the mouth on the next brush of the teeth. Some authorities therefore recommend that users discard toothbrushes every two weeks since it has been found that it takes less than three weeks for bacteria to heavily infect the bristles of brushes constantly used in warm environments.

However, as our society moves away from the disposable era toward an era of conservation of resources, throwing away a toothbrush every two weeks is no longer acceptable. Not only does such a program waste the natural resources used in producing the toothbrush, but toothbrushes are commonly made of materials which do not easily degrade in landfills, which contributes to the general problem of using up available disposal sites.

A toothbrush with a disposable bristle head allows the owner to dispose only a part of the brush, rather than the whole brush. Such a program is much more acceptable environmentally and encourages frequent discarding of the contaminated bristles, thus minimizing the potential of reinfecting the mouth with bacteria.

In addition, a toothbrush with a detachable head allows other dental appliances such as picks or bristle heads with differently shaped or different stiffness bristles to be mounted on the handle.

Although toothbrushes with disposable bristle heads are known in the art, it has been found that consumers will not pay extra for such a toothbrush, because it is just as economical to dispose the entire brush as to dispose of the bristle head only. In order to make a disposable head toothbrush marketable, an incentive must be provided to the consumer to dispose only the head, while keeping the handle. The present invention incorporates such an incentive.

As the United States population ages, more and more people become subject to diseases, such as arthritis, associated with age. People with arthritis in their hands have great difficulty in closing their fingers around slim objects, such as the handle of an ordinary toothbrush. Therefore, a need exists for a toothbrush with an enlarged handle which can comfortably be gripped by a person with arthritis or other disabling disease causing limited use of the hands. Such a handle will be substantial enough as to last many years.

People without arthritis can also benefit from an enlarged grip because the toothbrush will be less likely to slip or twist in the mouth as the handle becomes coated with toothpaste and saliva. This would be of particular benefit to persons with sensitive or diseased gums, as the lack of slipping or twisting can help prevent injury to the gums.

Consumers will be unwilling to dispose a toothbrush with a handle designed to last for many years and unless the toothbrush is provided with a disposable head, the problems mentioned above of reinfection of the mouth can easily occur.

The combination of an incentive to keep the handle and dispose only the head, the comfort of the enlarged handle, and the medical advantages of a disposable head combine to establish a need for a toothbrush with a detachable, disposable head and an enlarged, comfortable handle.

In addition, consumers will be more likely to exercise proper dental hygiene if a rack is provided which securely holds brushes, toothpaste, and mouthwash either on the vanity or mounted on a wall. This prevents the toothbrushes from becoming contaminated because they are allowed to dry. It has been found that bacterial contamination of toothbrushes is substantially reduced if the brush is permitted to become thoroughly dry between users. The rack also prevents these dental hygiene items from cluttering up the bathroom. Because of the large size of the brush handle, conventional brush holders with apertures into which the brush is inserted will not work. The rack must therefore be specially adapted to hold the enlarged brush. In so doing, it is possible to allow a toothbrush tube with an appropriate cap to be mounted on the rack, and to allow a mouthwash bottle with an appropriately adapted bottom to be rack mounted.

SUMMARY OF THE INVENTION

A dental hygiene apparatus, comprised of a toothbrush with a detachable, disposable head and an enlarged handle providing a comfortable, secure grip for people with limited use of the hand. The apparatus also comprises a rack with means adapted to securely hold a plurality of brushes along with a toothpaste tube and a mouthwash bottle.

A principal object and advantage of the present invention is that it provides a toothbrush with a bristle head that is easily detached and disposed of, yet which does not twist in the mouth during use. A disposable head reduces the possibility of infection of the mouth caused by bacteria on the brush bristles.

Another object and advantage of the present invention is that it provides a manual toothbrush with an enlarged handle that provides a secure, comfortable grip even if the user has limited use of the hands, without the weight and expense of a power toothbrush.

Another object and advantage of the present invention is that it provides a rack for securely holding securely the enlarged handle toothbrush along with a toothpaste tube and a mouthwash bottle, to keep the brush clean and dry and reduce clutter on the bathroom vanity.

DETAILED DESCRIPTION OF THE PREFERRED EMBODIMENTS

Figure 5:
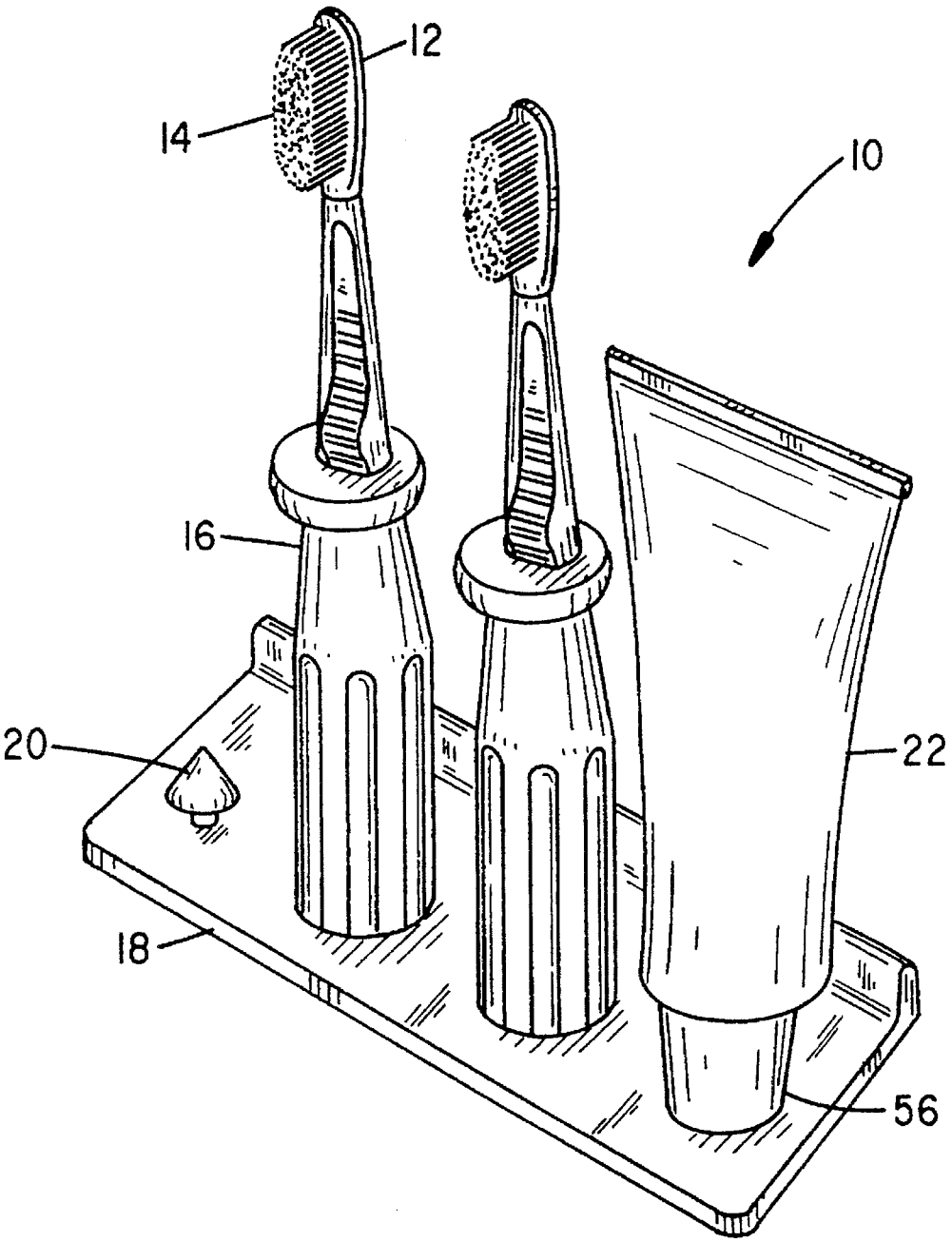
FIG. 5 is perspective view of the dental hygiene apparatus of the present invention.

The dental hygiene apparatus of the present invention is shown as the number 10 in FIG. 5. The dental hygiene apparatus 10 comprise a manual toothbrush 12, a rack 18, and a means 20 for securing the toothbrush 12 to the rack 18.

Figure 1:
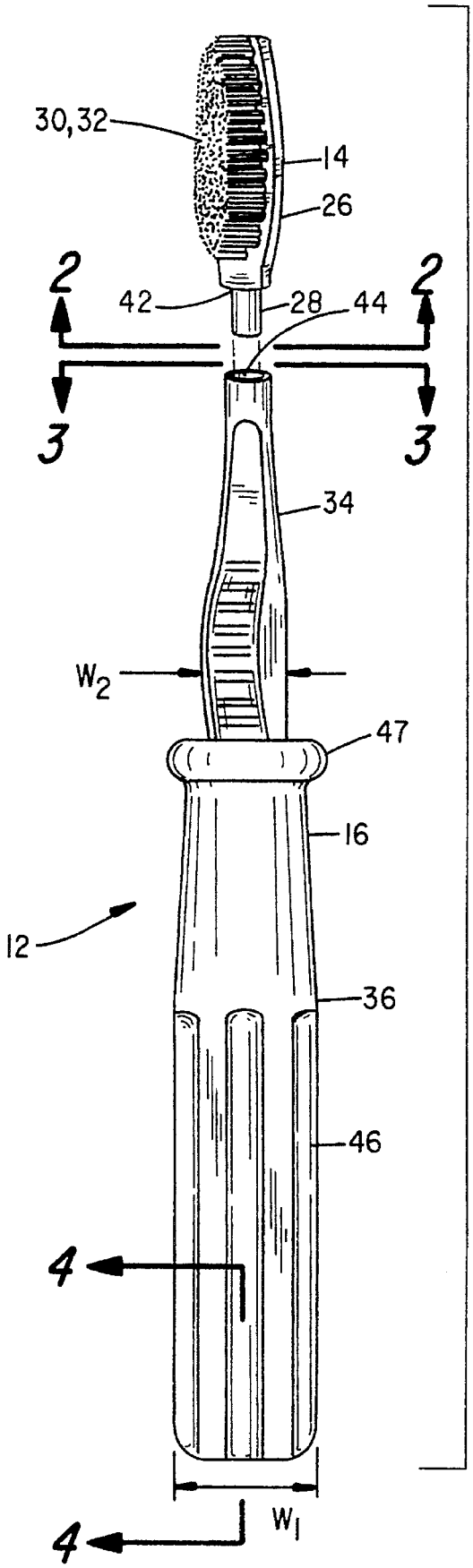
FIG. 1 is a perspective view of the toothbrush of the present invention.
Figure 4:
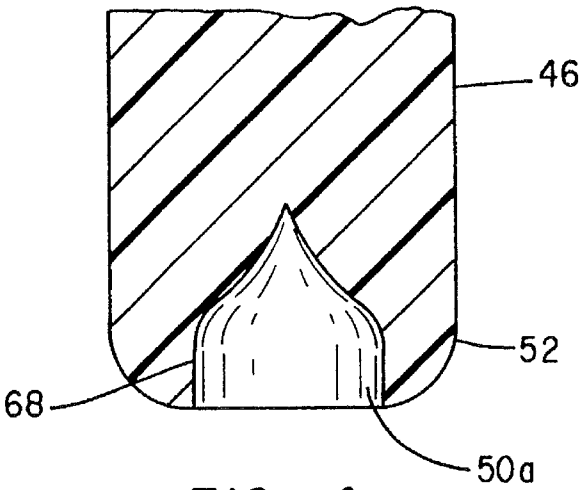
FIG. 4 is a cross-section taken along the line 4—4 of FIG. 1.
Figure 3:
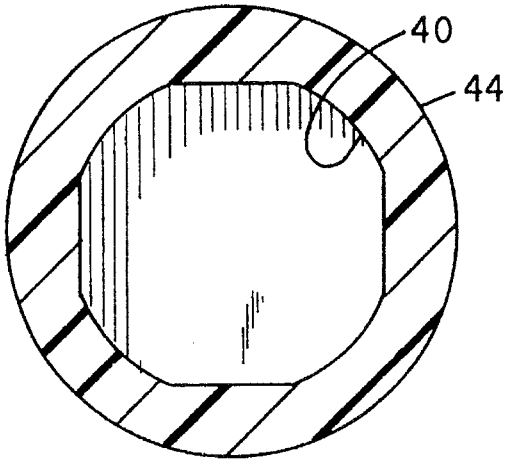
FIG. 3 is a cross-section taken along the line 3—3 of FIG. 1.
Figure 2:
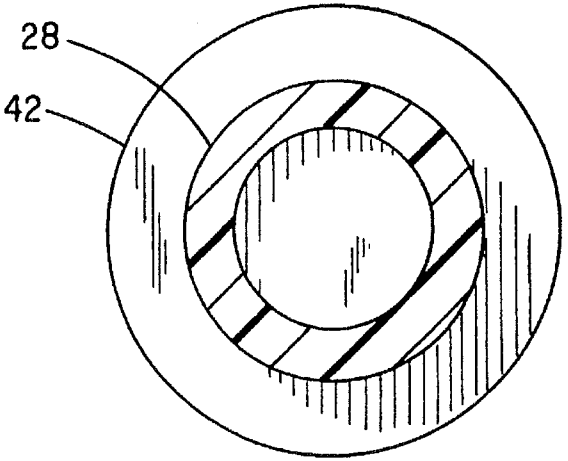
FIG. 2 is a cross-section taken along the line 2—2 of FIG. 1.

Referring particularly to FIG. 1, the manual toothbrush 12 further comprises a detachable head 14 and enlarged handle 16. The detachable head 14 comprises a body portion 26 and a connection portion 28. The body portion 26 has an oral hygiene applicator 30 such as a dental brush 30 having bristles 32 for cleaning teeth. Other oral hygiene applicators such as picks or brushes with different size or stiffness bristles (not shown) may be mounted on body portion 26.

The handle 16 has a tapered portion 34 and an enlarged portion 36. The detachable head 14 connects to the tapered portion 34 for use and is removed therefrom for disposal.

The connecting portion 28 mates with a bore 40 in the tapered portion 34 of the handle 16. In the figures, the connecting portion 28 is shown as being cylindrical and the bore 40 as polygonal in cross-section. However, both the connecting portion 28 and bore 40 may have other geometric shapes, i.e., triangular, square-shaped, rectangular or equivalent polygonal shape in cross-section.

The body portion 26 has a first curved surface 42 which is transverse to the connecting portion 28. The tapered portion 34 has a second surface 44 of similar curvature to surface 42. As the detachable head 14 is inserted into the tapered portion 34, the first curved surface 42 abuts against the second surface 44, urging the head 14 to center upon the tapered portion 34. A friction fit results to prevent twisting of the head 14 from the tapered portion 34 and the mating of surfaces 42 and 44 also prevents the head 14 from easily twisting on the tapered portion 34 during brushing of the teeth.

The enlarged portion 36 of the handle 16 is substantially cylindrical in shape in the preferred embodiment. The enlarged portion 36 has a plurality of grooves 46 for gripping the enlarged portion 36 with the fingers.

The enlarged portion 36 of the handle 16 also comprises a finger guard 47 which prevents the fingers from becoming coated with saliva and toothpaste and slipping during the brushing of the teeth.

Figure 9:
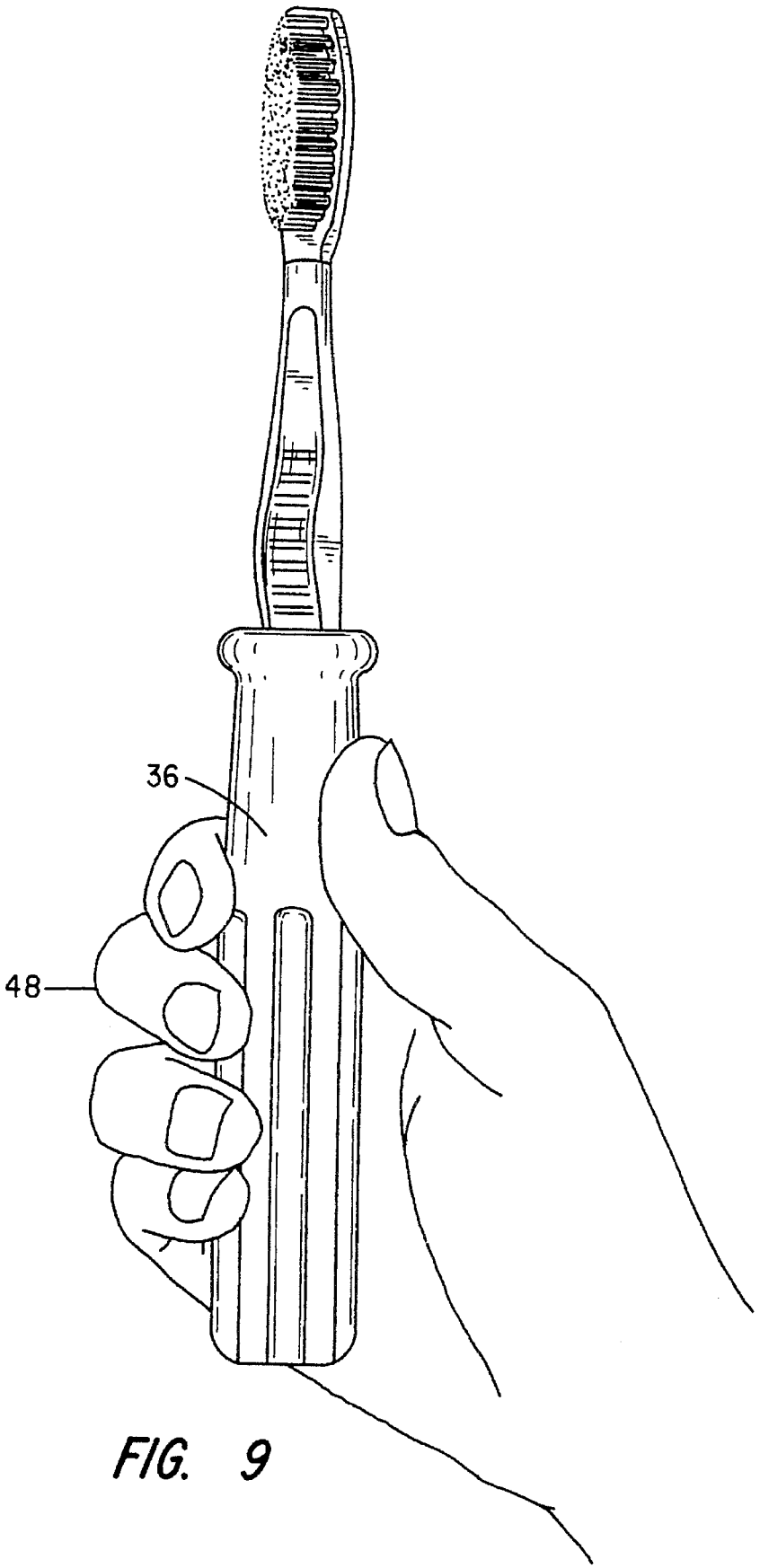
FIG. 9 is a perspective view showing the enlarged handle of the present invention being gripped by the fingers of a person's hand.

In the preferred embodiment, the enlarged portion 36 has a width $W_1$ which is one and one-half to three times the width $W_2$ of the tapered portion 34. As can be seen in FIG. 9, this width and the substantially cylindrical shape of the enlarged portion 36 result in the ability for a person to grip the enlarged portion 36 by only slightly closing the fingers 48. It will be recognized by those skilled in the art that the dimensions of the enlarged portion 36 are not critical, it merely being important than the enlarged portion 36 be substantially cylindrical and of such a size that the user is not required to close the fingers 48 very much in order to securely grip the enlarged portion 36. People with limited rise of the hands may thus obtain a secure grip on the enlarged portion 36 without the need to close the fingers substantially, which is very painful or impossible for them.

Figure 6:
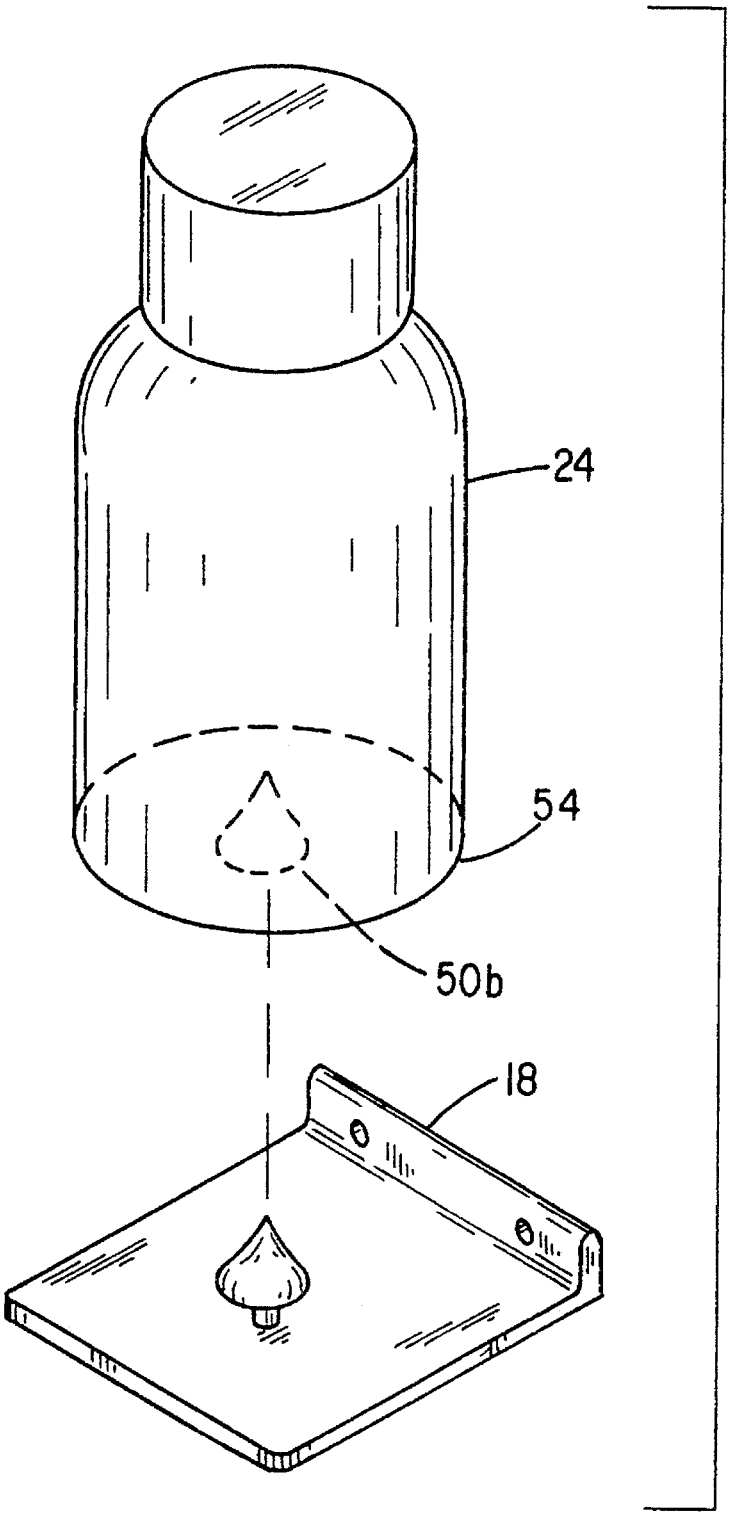
FIG. 6 is a perspective view of the rack of the present invention, showing a portion adapted to hold a bottle of mouthwash.
Figure 7:
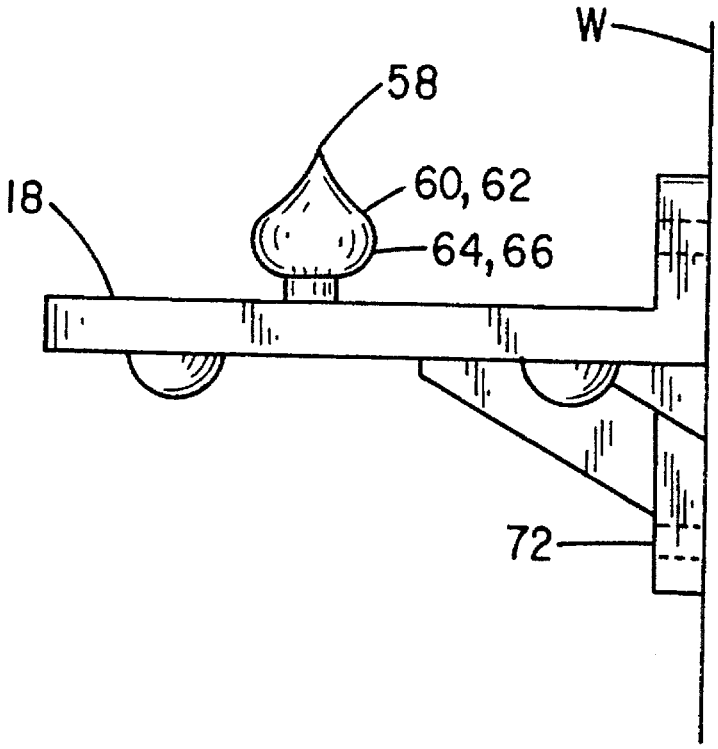
FIG. 7 is a side elevational view of the rack of the present invention, showing the wall mounting.
Figure 8:
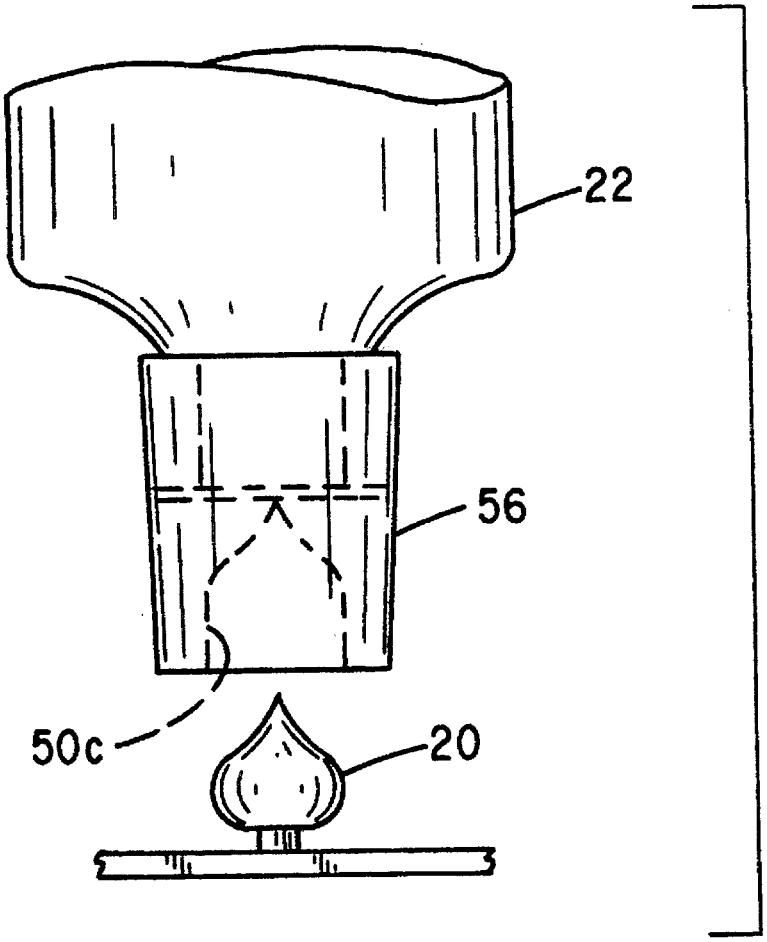
FIG. 8 is a side elevational view of the rack of the present invention and a toothpaste tube with a special cap which mates with the rack.

The rack 18 includes a means for securing the toothbrush 12 to the rack 18. In the preferred embodiment, the securing means is a spade-shaped projection 20. The spade-shaped projection 20 mates with a corresponding spade-shaped recess 50*a* in the end 52 of the enlarged portion 36 of the handle 16 of the toothbrush 12 opposite the tapered portion 34. A similar recess 50*b* shown in phantom in FIG. 6 is formed in the bottom 54 of a mouthwash bottle 24. Another similar recess 50*c* is formed in the cap 56 of the tube of dentifrice 22. The recesses 50*b*, 50*c* mate with the projections 20 to secure the mouthwash bottle 24 and the tube of dentifrice 22, respectively, to the rack 18.

Other shapes are possible for the projection 20, as for example a cone, a cylinder, a square, or other equivalent bodies. Additionally, the stem portion of the spade shape shown in the figures is optional. Alternatively, the securing means may be a clip or clasp or other equivalent.

The spade-shaped projection 20 comprises a conical tip 58, intermediate portion 60 with outwardly curving sides 62, and bottom portion 64 with inwardly curving sides 66. As the recess 50*a* is pressed downwardly over the projection 20, the sides 68 of the recess 50*a* grasp the outwardly curving sides 62 of the projection 20, thereby securing the recess 50*a* on the projection 20. Dentifrice tube 22 and mouthwash bottle 24 are similarly secured onto projections 20 of the rack 18.

The rack 18 also includes means 72 for mounting the rack 18 to a wall W. In the preferred embodiment the means for mounting is a bracket 72. Other embodiments such as clips, nails, screws or the equivalent may also be used.

The present may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A dental hygiene apparatus, comprising:

(a) a manual toothbrush with a head and a handle, said head detachably connected to said handle and said handle having a tapered portion and an enlarged portion, said enlarged portion being adapted to provide a secure, comfortable grip to persons with limited use of the hands, (b) rack;

(c) a plurality of projections on said rack, said plurality of projections having a spade shaped configuration; and (d) a selected one of said projections mating with a corresponding recess on said enlarged portion of said handle.

2. The dental hygiene apparatus of claim 1 wherein said detachable head comprises a body portion having a first end and a second end, an oral hygiene applicator at said first end and a loop shaped member at said second end.

3. The dental hygiene apparatus of claim 2 wherein said tapered portion contains a bore for receiving said loop shaped member.

4. The dental hygiene apparatus of claim 2 wherein said body portion has a first curved surface extending transverse from said loop shaped member and said tapered portion of said handle has a second surface of similar curvature against which said first curved surface abuts for centering said detachable head on said tapered portion and preventing said detachable head from easily twisting during brushing of the teeth.

5. The dental hygiene apparatus of claim 2 wherein said oral hygiene applicator is a dental brush having bristles for cleaning teeth.

6. The dental hygiene apparatus of claim 1 wherein said enlarged portion of said handle is substantially cylindrical.

7. The dental hygiene apparatus of claim 1 wherein said enlarged portion of said handle further comprises a finger guard adjacent said tapered portion.

8. The dental hygiene apparatus of claim 1 wherein the width of said enlarged portion of said handle is one and one-half to three times the width of said tapered portion.

9. The dental hygiene apparatus of claim 1 further comprising a mouthwash bottle having a recess in its bottom for mating with a selected one of said projections of said rack.

10. The dental hygiene apparatus of claim 1 further comprising a toothpaste container having a recess in its cap for mating with a selected one of said projections of said rack.

11. The dental hygiene apparatus of claim 1 wherein said rack further comprises a means for mounting said rack to a wall.

12. A toothbrush with a detachable head and a handle, said toothbrush comprising:

(a) an oral hygiene applicator on said detachable head;

(b) a loop shaped member on said detachable head;

(c) a first curved surface extending transverse from said loop shaped member;

(d) a tapered portion on said handle, said tapered portion containing a bore for frictionally receiving said loop shaped member and said tapered portion having a second curved surface extending transverse from an opening of said bore, said second curved surface configured to mate with said first curved surface for centering said detachable head;

(e) an enlarged portion on said handle opposite said tapered portion, said enlarged portion having a finger guard adjacent said tapered portion and a plurality of longitudinal grooves for gripping said toothbrush.

13. The toothbrush of claim 12 wherein the width of said enlarged portion of said handle is one and one-half to three times the width of said tapered portion.

14. The toothbrush of claim 12 wherein said oral hygiene applicator is a dental brush having bristles for cleaning teeth.

15. A dental hygiene apparatus, comprising:

(a) a manual toothbrush with a head and a handle, said head detachably connected to a said handle and said handle having a tapered portion and an enlarged portion, said enlarged portion being adapted to provide a secure, comfortable grip to persons with limited use of the hands, (b) a rack;

(c) a plurality of projections on said rack, said plurality of projections having an upper portion of decreasing diameter; and (d) a selected one of said projections mating with a recess on said enlarged portion of said handle.

16. The dental hygiene apparatus of claim 15 further comprising a mouthwash bottle having a recess in its bottom for mating with a selected one of said projections of said rack.

17. The dental hygiene apparatus of claim 15 further comprising a toothpaste container having a recess in its cap for mating with a selected one of said projections of said rack.

18. The dental hygiene apparatus of claim 15 wherein said detachable head comprises a body portion having a first end having an oral hygiene applicator and a second end having a loop shaped member.

19. The dental hygiene apparatus of claim 18 wherein said tapered portion contains a bore for receiving said loop shaped member.

20. The dental hygiene apparatus of claim 18 wherein said body portion has a first curved surface extending transverse from said loop shaped member and said tapered portion of said handle has a second surface of similar curvature against which said first curved surface abuts for centering said detachable head on said tapered portion and preventing said detachable head from easily twisting during brushing of the teeth.

21. The dental hygiene apparatus of claim 18 wherein said oral hygiene applicator is a dental brush having bristles for cleaning teeth.

* * * * *